United States Patent [19]

Wood, Jr.

[11] Patent Number: 4,880,134

[45] Date of Patent: Nov. 14, 1989

[54] PROTECTIVE CAP ASSEMBLY

[76] Inventor: Theodore N. Wood, Jr., R.D. 1, Box 578, Harveys Lake, Pa. 18618

[21] Appl. No.: 246,637

[22] Filed: Sep. 20, 1988

Related U.S. Application Data

[63] Continuation-in-part of Ser. No. 214,614, Jul. 1, 1988.

[51] Int. Cl.[4] ..... B65D 41/02

[52] U.S. Cl. ..... 220/85 P; 220/319; 137/382

[58] Field of Search ..... 220/85 P, 319, 326; 137/382

[56] References Cited

U.S. PATENT DOCUMENTS 1,948,953 2/1934 Wayer et al. ..... 220/85 P 4,648,526 3/1987 Wood ..... 137/382 X

*Primary Examiner*—Donald F. Norton

*Attorney, Agent, or Firm*—Bacon & Thomas

[57] ABSTRACT

A cap assembly for protecting the valved fitting of a pressurized fluid cylinder of the type provided with an externally threaded cap ring. The assembly includes an internally threaded adaptor ring engageable on the cap ring and a dome-shaped cap for enclosing and protecting the valved fitting, the cap being provided with opposed latches for detachable engagement with the adaptor ring.

14 Claims, 4 Drawing Sheets

FIG 6
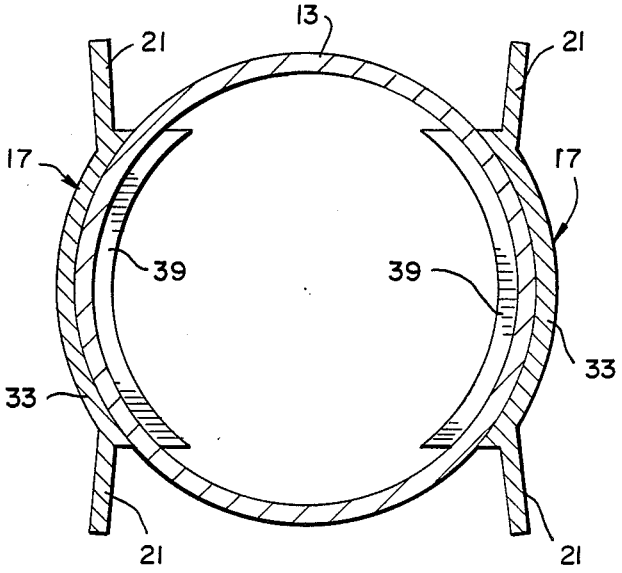
FIG 7
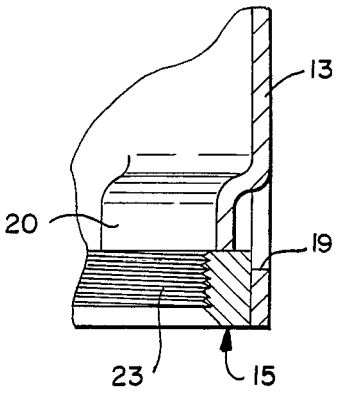
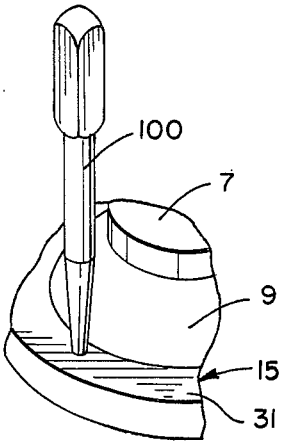
FIG 8
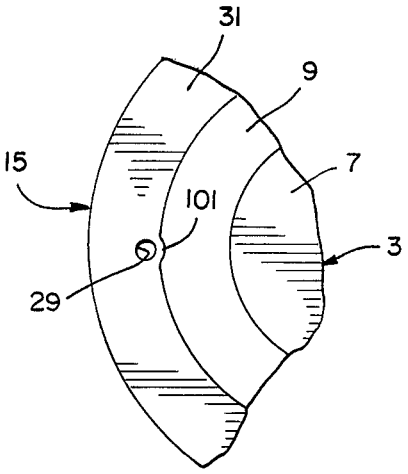
FIG 9

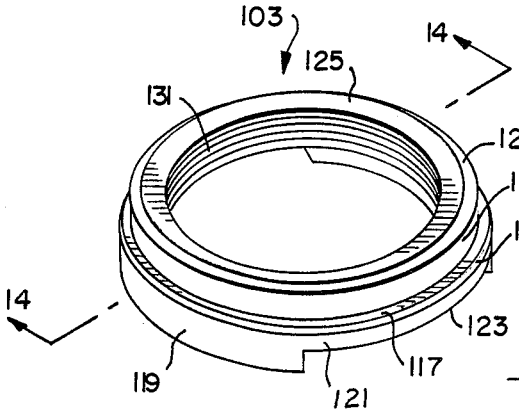
FIG 10
FIG 11
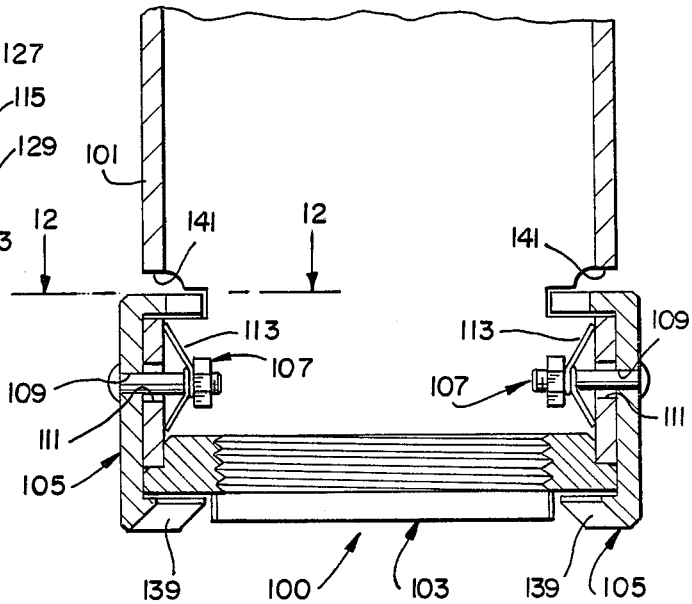
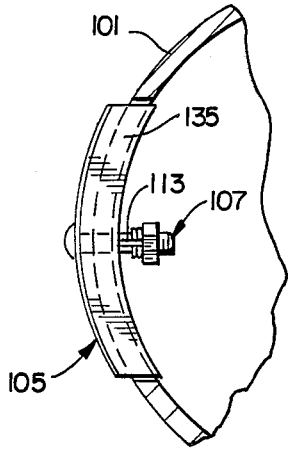
FIG 12
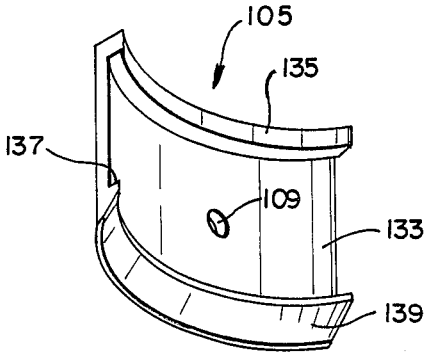
FIG 13
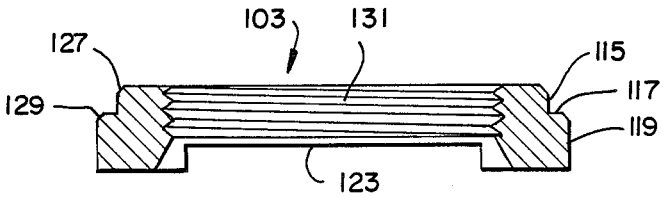
FIG 14

PROTECTIVE CAP ASSEMBLY

CROSS REFERENCE TO RELATED APPLICATION

This application is a continuation-in-part of Ser. No. 214,614 filed on July 1, 1988.

BACKGROUND OF THE INVENTION

1. Field of the Invention

The present invention generally involves the field of technology relating to protective devices for valved fittings projecting outwardly from a fluid container. More particularly, the invention relates to an improved protective cap assembly for the valved fitting of a pressurized fluid cylinder.

2. Description of the Prior Art

A conventional cylinder for containing pressurized fluids, such as oxygen and flammable gases, are provided at one end with a discharge opening through which the fluid is dispensed by means of a valved fitting. The fitting includes a manually operated valve that is supported on a cap ring and an associated collar secured to the cylinder. The cap ring is provided with male or external threading that is engageable by corresponding female or internal threading provided in a dome-shaped cap used for protecting the fitting. This protection is critical since the fluid stored within the cylinder is under high pressure so that a rupturing of the fitting from severe impact during handling may result in serious injury to personnel or damage to property.

The conventional threaded engagement between a protective cap and its associated valved fitting, although sufficient to meet minimum safety standards, nevertheless does have certain disadvantages. Since the cap is normally formed of steel, the threading in the cap has a tendency to corrode, thereby rendering it difficult to attach and remove the cap. Although the basic function of the cap is to protect the fitting from damage caused from a severe impact, such impact may nevertheless cause the corresponding threads of the cap and fitting to be deformed, thus rendering it difficult to remove the cap. Moreover, the nature of the threaded connection requires a significant amount of time and effort during removal or attachment of the cap.

These disadvantages of a threaded connection have been well recognized over the years and there have been attempts to design and construct threadless protective caps which are not only easier to attach to and remove from the cylinder, but also are capable of meeting the safety standards required of such caps. For example, it is known to provide a threadless cap which is secured to the cylinder by means of a bayonet-type connection. It is also known to provide caps which have hinged sections that pivot into an open position to permit access to the valved fitting. Other types of interconnection arrangements between the cap and cylinder have also been proposed, most of which require rotational movement of the cap in order to effect its locking engagement.

SUMMARY OF THE INVENTION

It is an object of the invention to provide an improved cap assembly for protecting an outwardly projecting valved fitting of a fluid container.

It is another object of the invention to provide an improved protective cap assembly for the valved fitting of a pressurized fluid cylinder.

It is a further object of the invention to provide an improved protective cap assembly that may be quickly attached to or removed from a fluid cylinder for the purpose of protecting a valved fitting of the cylinder from damage caused by severe impacts.

It is yet another object of the invention to provide an improved protective cap assembly for the valved fitting of a pressurized fluid cylinder wherein the cap is of simple construction, economical to manufacture and is secure against inadvertent detachment.

It is still an object of the invention to provide an improved protective cap assembly which may be utilized with the valved fitting of a conventional pressurized cylinder and without requiring the physical modification thereof.

These and other objects of the invention are realized by providing a protective cap assembly which essentially includes a domed-shaped cap and an associated adaptor ring. The adaptor ring is provided with internal threading that corresponds to and is engageable with the external threading provided on the existing cap ring of a conventional pressurized fluid cylinder. The ring also includes chamfered surfaces on its upper portion and corresponding opposed locking engagement surfaces on its lower portion.

The cap is provided with a pair of opposed spring-biased latches, with each latch including an upper flange disposed inwardly through a corresponding circumferential slot in the cap and a corresponding inwardly directed lower flange.

The adaptor ring is initially threadedly engaged onto the cap ring of the cylinder and thereafter may be secured against inadvertent removal therefrom by deforming its internal threading inwardly against the external threading of the cap ring. Attachment of the cap is effected by moving the cap longitudinally towards and enclosing the valved fitting therein, and thereafter impacting the lower arcuate flanges of the latches against the chamfered surfaces of the adaptor ring, causing the latches to be urged outwardly of the cap under spring bias. Continued movement of the cap results in the lower arcuate flanges snapfitting over and inwardly of the ring onto the opposed locking surfaces, thereby securely locking the cap to the valved fitting. Removal of the cap is effected by pivoting the lower portions of the latches outwardly and thereby release the lower flanges from their engagement with the locking surfaces.

Other objects, features and advantages of the invention shall become apparent from the following detailed description of preferred embodiments thereof when taken in conjunction with the drawings wherein like reference characters refer to corresponding parts in the several views.

BRIEF DESCRIPTION OF THE DRAWINGS

FIG. 6 is a cross-sectional view taken along the line 6—6 of FIG. 5, but shown without the adaptor ring.

FIG. 7 is a partial cross-sectional view taken along the line 7—7 of FIG. 5.

FIG. 8 is a partial perspective view showing a preferred manner in which the adaptor ring may be secured against inadvertent removal from the cap ring of the cylinder.

FIG. 9 is a partial top plan view showing the adaptor ring secured to the cap ring of the cylinder.

FIG. 10 is a perspective view of an adaptor ring used in a protective cap assembly according to a second embodiment of the invention.

FIG. 11 is a side elevational view of the cap assembly according to the second embodiment, and shown with the latches depicted in their positions of engagement on the locking surfaces of the adaptor ring.

FIG. 12 is a partial cross-sectional view taken along the line 12—12 of FIG. 11.

FIG. 13 is a perspective view of a latch utilized in the cap assembly of FIG. 11.

FIG. 14 is a cross-sectional view taken along the line 14—14 of FIG. 10.

DETAILED DESCRIPTION OF THE PREFERRED EMBODIMENTS

Figure 1:
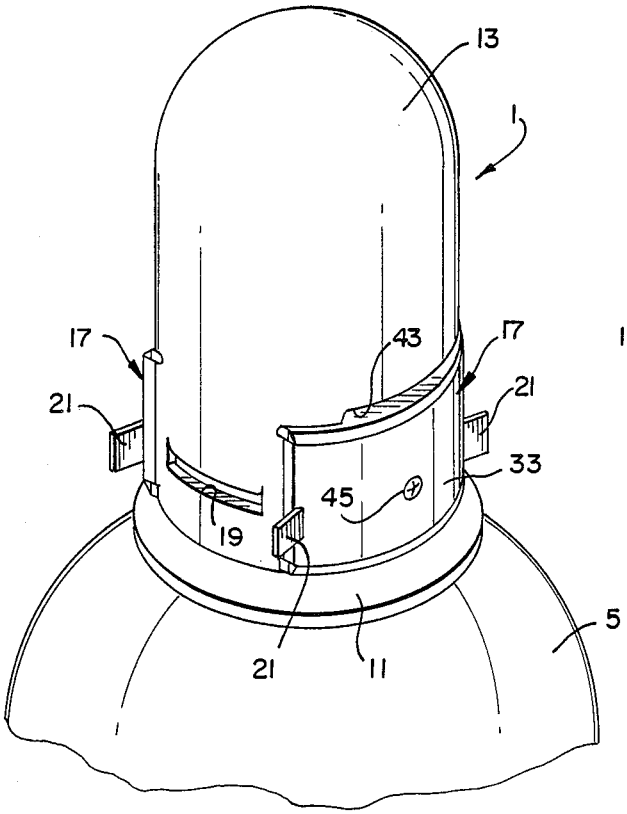
FIG. 1 is a partial perspective view of a protective cap assembly according to a first embodiment of the invention shown in its position of attachment at the valved discharge end of a conventional pressurized fluid cylinder.
Figure 2:
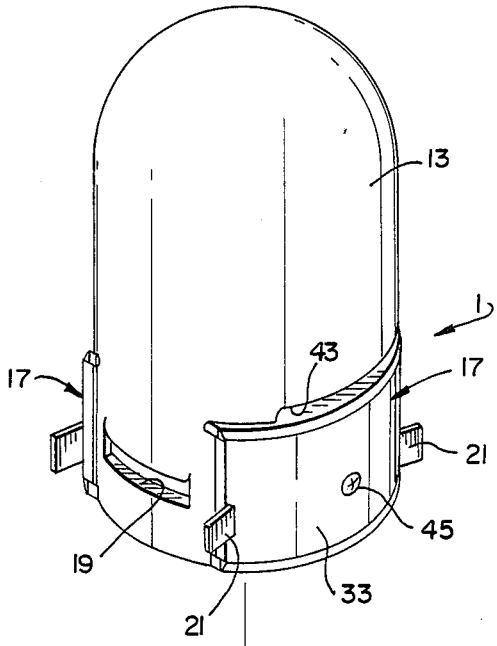
FIG. 2 is a partial exploded perspective view of the cap assembly shown in FIG. 1, and particularly depicting the cap, adaptor ring and valved fitting of the cylinder.
Figure 2:
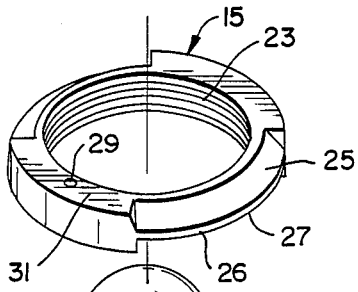
Figure 2:
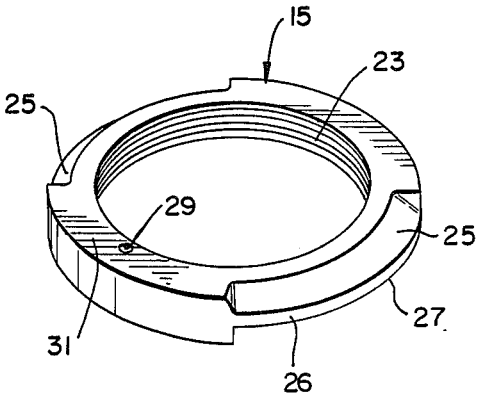

A protective cap assembly 1 according to a first embodiment of the invention, shall now be described with initial reference to FIGS. 1 and 2. As shown therein, assembly 1 may be used to protect a valved fitting 3 secured to the discharge end of a conventional pressurized fluid cylinder 5. Fitting 3 is also of conventional design and includes a manually operated valve 7, a cap ring 9 provided with external threading 10 and a collar 11. As is apparent, assembly 1 is intended to be used in conjunction with a conventional cylinder 5 and its associated fitting 7 without requiring any physical modification of these existing structures.

Cap assembly 1 includes a dome-shaped cap 13 and an adaptor ring 15, the latter serving to permit the detachable engagement of cap 13 to valved fitting 3. Cap 13 is provided with a pair of opposed latches 17 which partially extend circumferentially around the lower portion of cap 13. A pair of opposed openings 19 are provided on either side of cap 13 and disposed midway between latches 17, although only a single opening 19 is shown in FIGS. 1 and 2. Each opening 19 is formed by deforming the sidewall of cap 13 inwardly to define a downwardly extending flange 20, as shown in FIG. 7. Each latch 17 is also provided with a pair of outwardly extending handles 21 to permit manual engagement and release of latch 17.

Figure 3:
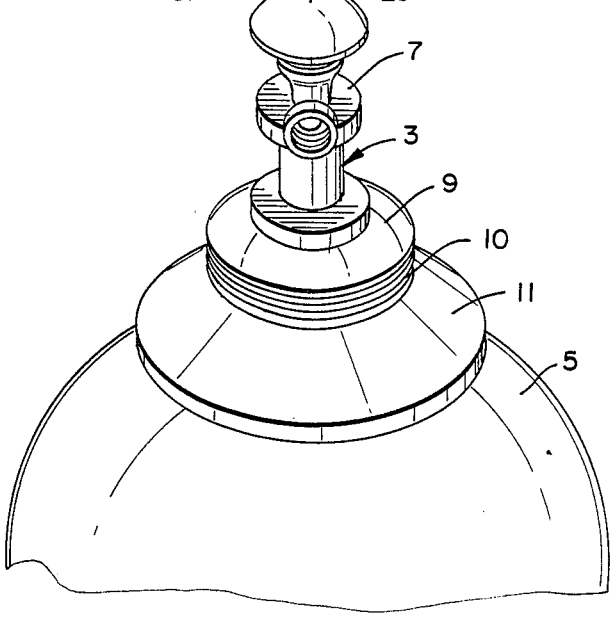
FIG. 3 is a perspective view of the adaptor ring forming part of the cap assembly shown in FIG. 1.

With further reference to FIG. 3, adaptor ring 15 is provided with an internal threaded portion 23 which corresponds to external threaded portion 10 of cap ring 9 so that ring 15 may be disposed in threaded engagement with ring 9. Ring 15 is also provided at its upper portion with a pair of opposed downwardly chamfered surfaces 25 which correspond in circumferential positioning to latches 17 of cap 13 and terminate at their outer peripheral edges in a pair of longitudinally extending side surfaces 26. The lower portion of ring 15 is provided with a pair of opposed locking surfaces 27 disposed directly opposite surfaces 25. Ring 15 may also be provided with a cylindrical passageway 29 which extends through an upper surface 31 of ring 15 and having a longitudinal axis disposed parallel to the central axis of ring 15 for the purpose of permitting ring 15 to be permanently secured to cap ring 9. Passageway 29 is positioned adjacent threaded portion 23 for receiving a tool to deform threaded portion 23 inwardly against threaded portion 10 of ring 9 in a manner to be later described.

Figure 5:
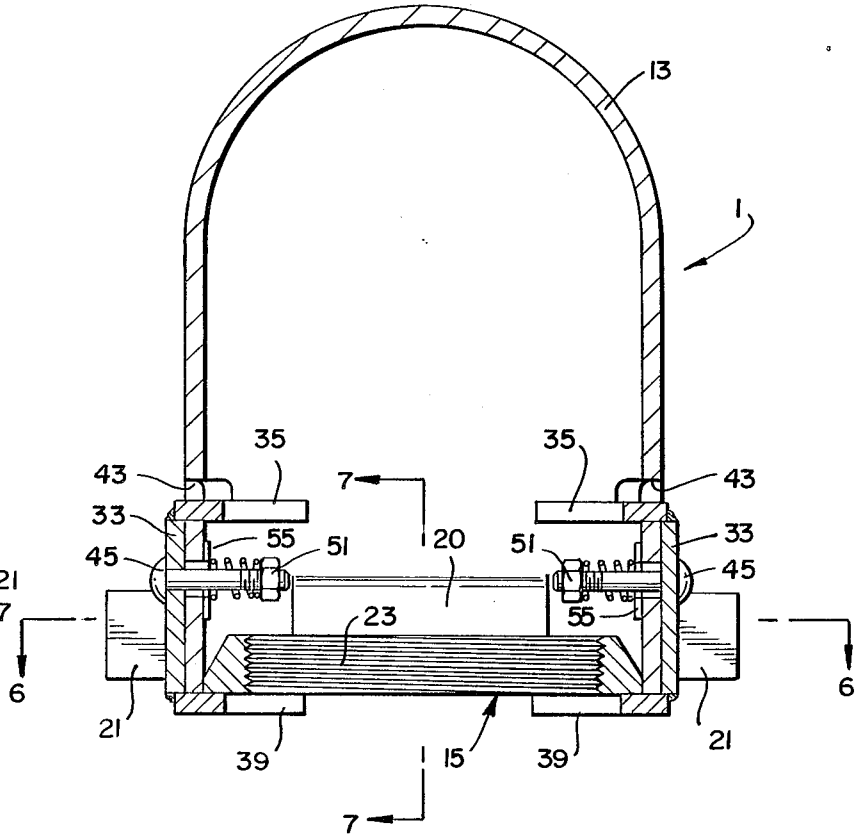
FIG. 5 is a side elevational view of the cap assembly shown in FIG. 4, with the latches depicted in their positions of engagement on the locking surfaces of the adaptor ring.
Figure 4:
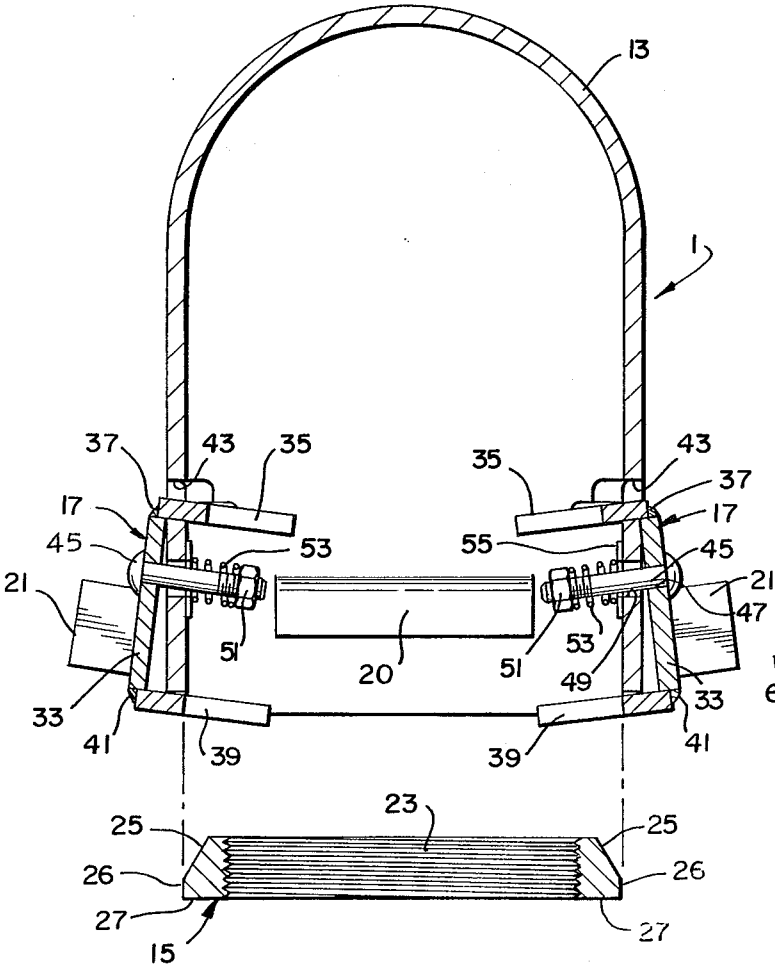
FIG. 4 is a side elevational view showing only the cap assembly of FIG. 1, with the cap disposed above the adaptor ring and the latches in their outwardly pivoted positions.

The details of latches 17 and the manner in which they permit detachable engagement of cap 13 to adaptor ring 15 shall now be described with particular reference to FIGS. 4 and 5. As seen in FIG. 4, cap 13 is spaced from adaptor ring 15 in preparation for engagement therewith by moving cap 13 longitudinally towards ring 15. FIG. 5 shows cap 13 in full engagement with ring 15. In both figures, it may be envisioned that ring 15 is in threaded engagement with cap ring 9 or other correspondingly threaded fixture of a container provided with a similar outwardly extending valved fitting.

Latches 17 are of identical construction, with each latch 17 including a substantially rectangular support plate 33 having a curvature conforming to the external circumferential curvature of cap 13. An upper flange 35 is secured along the top edge of plate 33, preferably by a weld 37. A corresponding lower flange 39 is secured along the bottom edge of plate 17, preferably also by a weld 41. Flange 35 extends inwardly of cap 13 through a circumferential slot 43 formed in the wall thereof, as may be more clearly seen in FIGS. 1 and 2. The bottom edge of plate 33 is preferably coextensive with the bottom edge of cap 13 so that, when plate 33 is disposed substantially flush against the exterior wall of cap 13, lower flange 39 also extends inwardly of cap 13 and is disposed directly below upper flange 35. As also seen in FIG. 4, slot 43 is configured and sized in any manner well known in the art so as to permit flange 39 and the bottom portion of plate 33 to be moved outwardly from cap 13 by pivoting latch 17 about slot 43. As further evident from FIG. 5, flanges 35 and 39 are of the same size and configuration, extend inwardly into the interior of cap 13 to the same degree and are perpendicular to the longitudinal axis of cap 13 when plate 33 is disposed in full engagement with the exterior wall of cap 13. Flanges 35 and 39 are preferably of arcuate configuration to provide maximum clearance for valved fitting 3.

Each latch 17 is preferably secured to cap 13 by means of a bolt 45 disposed through an aperture 47 in plate 33 and a corresponding coaxial aperture 49 formed in the wall of cap 13. The diameter of aperture 49 is larger than that of aperture 47 in order to permit the outward pivotal movement of latch 17 in the manner previously described. Bolt 45 is provided with a threaded end on which a nut 51 is engaged and spaced from the interior wall of cap 13. A coil spring 53 and a washer 55 are disposed between nut 51 and the interior wall of cap 13 for biasing plate 33 against the exterior wall of cap 13. Thus, each latch 17 is always urged towards its fully engaged position as shown in FIG. 5 by means of spring 53.

With reference to FIG. 6, latches 17 are depicted in their fully engaged positions, as previously shown in FIG. 5, but without adaptor ring 15. As apparent, lower flanges 39 and support plates 33 preferably have the same circumferential curvature as cap 13. Although not depicted in FIG. 6, upper flanges 35 are also of the same configuration and curvature as flanges 39.

As noted in FIGS. 5 and 7, the external diameter of adaptor ring 15 corresponds substantially to the internal diameter of, cap 13 so that ring 15 may be received therein. Full insertion of ring 15 within cap 13 is established by upper surface 31 of ring 15 being disposed in abutting engagement with the corresponding lower edges of opposed flanges 20. When this occurs, the bottom of ring 15 is substantially coplanar with the lower edge of cap 13.

The manner in which adaptor ring 15 may be secured against inadvertent removal to cap ring 9 shall now be described with reference to FIGS. 8 and 9. After adaptor ring 31 has been disposed in full threaded engagement with cap ring 9, a conventional punch 100 may be inserted in passageway 29 and struck with sufficient force to cause deformation of internal threaded portion 23 of cap 31 into external threaded portion 10 of ring 9. This is generally shown at 101 in FIG. 9. In this way, adaptor ring 31 is securely engaged with cap ring 9 against possible inadvertent removal. Although this arrangement for securing ring 15 to ring 9 is a preferred embodiment of the invention, it is understood that other arrangements or means may also be utilized to advantage in the practice of the invention.

The manner in which cap assembly 1 is utilized to protect valved fitting 3 of cylinder 5 shall now be described with reference to the figures, and particularly with respect to FIGS. 4 and 5. It shall be assumed from FIG. 4 that adaptor ring 15 has been initially secured in threaded engagement with cap ring 9 in the manner previously described. Attachment of cap 1 is accomplished by moving cap 1 longitudinally against ring 15 until lower flanges 39 engage chamfered surfaces 25. By applying sufficient downward pressure to cap 13 or alternately grouping handles 21 and pulling outwardly of cap 13, the bias of springs 53 are overcome so that flanges 39, because of their arcuate configuration, may slide downwardly along surfaces 25, thereby moving latches 17 outwardly. Continued movement of cap 13 against ring 15 causes flanges 39 to slide down along side surfaces 26 and thereafter snap inwardly into engagement onto locking surfaces 27. The fully engaged positions of latches 17 are shown in FIG. 5. The configuration and disposition of latches 17 result in their secure engagement with ring 15, notwithstanding any severe impacts which might be imparted to cap assembly 1 during the handling of cylinder 5. In this manner, fitting 13 is safely enclosed within cap 13 and protected from damage.

The removal of cap 13 in order to gain access to fitting 3 is easily accomplished by simply grasping handles 21 and pulling same outwardly of cap 13. This immediately releases flanges 39 from locking surfaces 27 and permits the quick detachment of cap 13 from adaptor ring 15.

Cap assembly 1 may, of course, be constructed from any material well known in the art and deemed suitable for the practice of the invention as described herein. Assembly 1 is preferably formed of metal in order to withstand the severe impacts which normally accompany the handling of pressurized fluid cylinders and other containers having outwardly extending valved fittings with which assembly 1 may be utilized.

A second embodiment of a protective cap assembly according to the invention shall now be described with reference to FIGS. 10–14. As shown therein, a protective cap assembly 100 also includes a dome-shaped cap 101, shown partially in FIG. 11, and adaptor ring 103, and a pair of opposed latches 105. Each latch 105 is secured to cap 111 by means of a nut and bolt assembly 107 which is engaged through corresponding apertures 109 and 111 of different sizes and formed in latch 105 and cap 101, respectively, in the same manner previously described for the first embodiment. In this case, a metal leaf spring 113 is used in conjunction with assembly 107 for biasing latch 105 against cap 101. However, it is understood that a coil spring may also be utilized in the manner previously described herein.

With particular reference to FIGS. 10 and 14, it shall be noted that adaptor ring 103 is of the same general configuration as ring 15 of the first embodiment, but differs in several aspects. First, as evident from FIG. 11, the external diameter of ring 103 is the same as the external diameter of cap 101. Ring 103 is also provided with a necked-down portion 115 having an external diameter corresponding substantially to the internal diameter of cap 101. Portion 115 therefore defines an annular surface 117. Thus, full engagement of ring 103 within cap 101 is realized when portion 115 is received therein therein and the bottom circumferential edge of cap 101 is disposed in abutting engagement against annular surface 117, as shown in FIG. 11. The width of surface 117 corresponds to the wall thickness of cap 101. As further evident from FIG. 10, portion 115 and surface 117 are each continuous around the circumference of ring 103.

As in the case of adaptor ring 15, ring 103 also includes a circumferential surface 119 that is interrupted by a pair of longitudinally extending opposed side surfaces 121. Each surface 121 extends from annular surface 117 and terminates at a locking surface 123 which is parallel to surface 117. Ring 103 is also provided with a uniform and continuous circular upper surface 125. The intersecting circumferential edge of surface 125 and portion 115 is provided with a circumferential chamfer 127, and the intersecting edge of surface 117 and surface 119 is also provided with a circumferential chamfer 129, as evident from both FIGS. 10 and 14. As also shown, ring 103 is provided with an internal threaded portion 131 for threaded engagement with an externally threaded cap ring in the manner previously described for the first embodiment.

With particular reference to FIGS. 12 and 13, each latch 105 of assembly 100 is also similar in configuration to latch 17 of the first embodiment but differs also in several aspects. Latch 105 is preferably integrally formed of metal and also includes a substantially rectangular support plate 133 having a curvature conforming to the external circumferential curvature of cap 101. An upper flange 135 and a lower flange 137, each being preferably of arcuate configuration corresponding to the curvature of plate 133, are integrally formed at opposed edges thereof. Flange 137 is provided with an outwardly extending chamfer 139.

The manner in which cap assembly 100 is assembled shall now be described with particular reference to FIGS. 11 and 12. As noted therein, each latch 105 has its upper flange 135 disposed within a corresponding opposed slot 141 formed in the wall of cap 101. As in the first embodiment, slots 141 are configured and sized in any manner well known in the art to permit the outward pivoting of latches 105 about their respective upper flanges 135 inserted therethrough. Lower flange 137 of each latch 105 is engaged onto its corresponding locking surface 123 of adaptor ring 103. Removal of cap 101 from ring 103 may be effected by simply grasping the lower portions of latches 105 and pulling same outwardly to free flanges 137 from surfaces 123. As is also apparent from the configuration of ring 103, chamfer 127 facilitates the insertion of portion 115 within cap 101, while chamfer 129 is engaged by chamfers 139 of latches 105, the latter engagements causing latches 105 to pivot outwardly against the bias of springs 113.

It should further be noted from the configuration of ring 103 that it is not necessary to longitudinally align latches 105 with their corresponding locking surfaces 123 when cap 101 is brought into engagement with ring 103. In the event lower flanges 137 are misaligned from surfaces 121 when annular surface 117 is brought into engagement with the peripheral edge of cap 101, it is only necessary to rotate cap 101 until bottom flanges 137 snap into engagement with their corresponding locking surfaces 123.

It is to be understood that the forms of the invention herein shown and described are to be taken as preferred embodiments of the same, and that various changes in shape, material, size and arrangement of parts may be resorted to without departing from the spirit of the invention or scope of the subjoined claims.

I claim:

1. A cap assembly for protecting an outwardly extending valved fitting provided with an externally threaded cap ring at the discharge end of a fluid container, the assembly comprising:

(a) an adaptor ring provided with internal threading for threaded engagement with the external threading of the cap ring;

(b) a cap for enclosing and protecting the valved fitting;

(c) latch means carried by the cap for permitting longitudinal detachable engagement of the cap and adaptor ring when the adaptor ring is in threaded engagement with the cap ring; and (d) the latch means being movable outwardly of the cap to permit the cap to receive the adaptor ring therein, and thereafter movable inwardly towards the cap to secure the cap to the adaptor ring.

2. The cap assembly of claim 1 further including means for biasing the latch means against the cap.

3. The cap assembly of claim 2 wherein the latch means includes a pair of opposed latches.

4. The cap assembly of claim 3 wherein:

(a) the cap includes a pair of opposed circumferential slots formed therein;

(b) each latch includes an upper flange disposed through a circumferential slot and extending inwardly of the cap, each slot being configured and sized to permit its corresponding latch to pivot about the slot during the outward movement of the latch;

(d) each latch further including a lower flange; and (e) the adaptor ring including a pair of opposed lower locking surfaces engageable by the lower flanges for securing the cap to the adaptor ring.

5. The cap assembly of claim 4 wherein:

(a) each latch further includes a curved support plate;

(b) the upper and lower flanges are each of an arcuate configuration and carried by opposed curved edges of their corresponding support plate; and (c) the arcuate curvature of the flanges and the curvature of the support plate are substantially the same.

6. The cap assembly of claim 4 wherein:

(a) the adaptor ring includes an upper chamfered surface; and (b) each latch being movable outwardly when the lower flange is engaged against the chamfered surface, and the cap is secured to the adaptor ring when the latch is moved inwardly to engage the lower flange onto the locking surface.

7. The cap assembly of claim 6 wherein each lower flange includes an outwardly extending chamfer for engaging the chamfered surface of the adaptor ring.

8. The cap assembly of claim 1 wherein the adaptor ring includes a reduced circumferential portion receivable within the cap and an annular surface engageable against an open edge of the cap when the cap is secured to the adaptor ring.

9. The cap assembly of claim 1 wherein the latch means includes a handle means for permitting the latch means to be manually moved outwardly.

10. The cap assembly of claim 1 further including means carried by the cap and engageable by the adaptor ring when the adaptor ring is fully received within the cap.

11. The cap assembly of claim 10 wherein the means engageable by the adaptor ring includes a pair of inwardly extending flanges formed in opposed wall portions of the cap.

12. The cap assembly of claim 1 further including means for preventing inadvertent removal of the adaptor ring from its threaded engagement with the cap ring.

13. The cap assembly of claim 12 wherein the means for preventing inadvertent removal includes a longitudinal passageway formed in the adaptor ring and configured to receive a punch tool for deforming the internal threading of the adaptor ring into the external threading of the cap ring.

14. A cap assembly for protecting an outwardly extending valved fitting provided with an externally threaded cap at the discharge end of a pressurized fluid cylinder, the assembly comprising:

(a) an adaptor ring provided with internal threading for threaded engagement with the external threading of the cap ring, an upper chamfered surface and a pair of opposed lower locking surfaces;

(b) a dome-shaped cap for enclosing and protecting the valved fitting, the cap being configured for receiving at least a portion of the adaptor ring therein, and including a pair of opposed circumferential slots;

(c) a pair of spring-biased opposed latches carried by the cap for permitting longitudinal snapfit detachable engagement of the cap and adaptor ring when the adaptor ring is in threaded engagement with the cap ring, each latch including a curved support plate, and upper and lower arcuate flanges carried by opposed curved edges of the support plate, the upper arcuate flange being received through a corresponding circumferential slot and extending inwardly of the cap, each slot being configured and sized to permit its corresponding latch to pivot about the slot; and (d) the latches being movable outwardly against the spring-bias when the lower arcuate flanges are engaged against the chamfered surface of the adaptor ring, and the cap is secured to the adaptor ring when the latches are moved inwardly to engage the lower arcuate flanges onto the lower locking surfaces of the adaptor ring.

* * * * *